US006190086B1

(12) United States Patent
Mueller et al.

(10) Patent No.: US 6,190,086 B1
(45) Date of Patent: Feb. 20, 2001

(54) METHOD FOR LAYING MOSAIC ELEMENTS

(75) Inventors: Heiko Mueller; Thomas Mueller, both of Lobenstein (DE)

(73) Assignee: Pflaster-Mueller GmbH & Co. KG, Lobenstein (DE)

( * ) Notice: Under 35 U.S.C. 154(b), the term of this patent shall be extended for 0 days.

(21) Appl. No.: 09/286,022

(22) Filed: Apr. 5, 1999

(30) Foreign Application Priority Data

Apr. 14, 1998 (DE) ..... 198 16 458

(51) Int. Cl.[7] ..... E01C 5/00
(52) U.S. Cl. ..... 404/34; 404/73; 428/44
(58) Field of Search ..... 404/17, 34, 73; 249/2; 428/44, 45

(56) References Cited

U.S. PATENT DOCUMENTS

| | | | | |
|---|---|---|---|---|
| 719,244 | * | 1/1903 | Mooney | 404/73 |
| 3,041,785 | * | 7/1962 | MacDonald et al. | 404/34 |
| 3,922,105 | * | 11/1975 | Bolli | 404/34 |
| 4,440,520 | * | 4/1984 | Fisher | 404/17 |

FOREIGN PATENT DOCUMENTS

| | | | |
|---|---|---|---|
| 7171812 | * | 12/1993 | (JP) . |
| 4320375 | * | 10/1987 | (SU) . |

* cited by examiner

*Primary Examiner*—Thomas B. Will
*Assistant Examiner*—Nathan Mammen
(74) *Attorney, Agent, or Firm*—Reed Smith LLP

(57) ABSTRACT

A method for laying a mosaic in which a quantity of n individual mosaic elements are arranged on a common support surface so as to be separated from one another by joints, preferably for laying natural stones to form natural stone paving. The method comprises the steps of placing a partial amount $n_1<n$ of mosaic elements inside of a frame on a work surface at a location separate from the laying site for the mosaic or framing such partial amount after placement on the work surface, wherein these $n_1$ mosaic elements are already positioned relative to one another in a manner corresponding to their respective position in the mosaic; subsequently filling the joints between the mosaic elements with a liquid medium; then, cooling the mosaic elements to a temperature at which the liquid medium solidifies, wherein there is formed a composite $V_1$ which is held together by the solidified medium; subsequently storing the composite $V_1$ at a temperature below the solidification temperature of the liquid medium until the laying of the mosaic is begun; producing and storing additional composites $V_2$, $V_3$ . . . $V_n$ with the rest of the partial amounts $n_2$, $n_3$ . . . $n_n$ of mosaic elements and analogous to the above steps; and, in order to lay the mosaic, transporting the composites $V_1$ . . . $V_n$ to the laying site, arranged on the supporting surface so as to correspond to the predetermined mosaic and, from this time onward, exposing them to the ambient temperature at the laying site for the purpose of thawing.

13 Claims, No Drawings

METHOD FOR LAYING MOSAIC ELEMENTS

BACKGROUND OF THE INVENTION a) Field of the Invention

The invention is directed to a method for laying a mosaic in which a quantity of n individual mosaic elements are arranged on a common support surface so as to be separated from one another by joints, preferably for laying natural stones to form natural stone paving. The method is suitable for all laying work for mosaic elements in which joints are provided between the individual elements.

b) Description of the Related Art

In the relevant methods known from the prior art for laying mosaics, the mosaic elements are positioned individually one after the other on a laying or setting surface and, in so doing, oriented relative to one another with respect to height in such a way that the top sides of all of the mosaic elements have approximately the same distance to the setting surface and, accordingly, a useful surface is formed which, depending on its purpose, can be walked upon and/or driven upon. As a rule, the mosaic elements are set at a distance from one another, so that joints are formed between the mosaic elements, which joints must subsequently be filled. The individual mosaic elements are fixed in position relative to one another and relative to the setting surface at the same time that the joints are filled.

When laying a pavement of natural stones, for example, a setting surface is initially prepared on a roughly 5-cm thick layer of sand or stone chippings, the so-called pavement bed. The natural stones are sorted on the setting surface or on this pavement bed and are individually fixedly set with a hammer according to the rules of paving technique, wherein spaces in the width of the joint remain between the natural stones. The joints are then filled with sand or stone chippings or a mixture of these two materials and the entire surface is vibrated. The individual natural stones are now arranged so as to be immovable with respect to one another and the pavement can also be loaded in the direction of the pavement bed.

The essential disadvantage in this process consists in that the work steps required for laying the mosaic must be carried out directly at the laying site and every stone must be set individually. The need for handling every stone individually results in a large amount of time spent at the laying site. Further, all of the work steps, especially when laying pavement, depend to a great extent on the weather because unfavorable weather conditions cause downtime and accordingly delay execution. Accordingly, in regions affected by frost the laying work can often come to a total standstill for long periods of time.

Further, a process for laying mosaic elements is known from the prior art, wherein a small quantity of mosaic elements is attached to a flexible carrier comprising woven material or plastic sheeting at a location separate from the laying site, namely such that the position and spacing of these mosaic elements relative to one another already correspond to the position in the subsequent surface-covering mosaic in its entirety. In this way, parts of the total mosaic are prepared and then these parts are stacked in pallets, for example, and transported to the laying site and finally assembled at the laying site to form the finished mosaic. A process of this kind is used, for example, in the laying of small to medium-sized wall tile or floor tile.

The fastening of the mosaic elements to the flexible carrier is carried out in general by gluing in a workshop. A bed of tile cement or tile mortar is prepared at the laying site and the flexible carrier with the glued on mosaic elements is embedded therein. In so doing, the carrier remains between the glue bed or mortar bed and underside of the tiles. This process is disadvantageous in that it is unsuitable for heavy mosaic elements such as natural stones for road paving because, on the one hand, the carrying capacity of the woven fabric or plastic sheeting is limited and, on the other hand, it is difficult to achieve a durable connection between the heavy natural stones and the carrier material. Moreover, particularly with respect to road paving, owing to the woven or plastic intermediate layer which would remain under the paving after it has been laid, the required minimum carrying capacity could not be achieved and the life of the paving would be negatively impacted.

OJBECT OF THE INVENTION

Proceeding from this prior art, it is the primary object of the invention to reduce the time expended for laying a quantity of n mosaic elements to form a total mosaic at the laying site and to limit extensively the dependence of the laying work on climatic influences at the laying site.

DESCRIPTION OF THE INVENTION AND THE PREFERRED EMBODIMENTS

According to the invention, this object is met in that the partial amount $n_1<n$ of mosaic elements is placed inside of a frame on a work surface at a location separate from the laying site for the mosaic or is framed after placement on the work surface, wherein these $n_1$ mosaic elements are already positioned relative to one another in a manner corresponding to their respective position in the mosaic, in that the joints between the mosaic elements are subsequently filled with a liquid medium, preferably water, whose melting and solidification temperature is approximately 0° C. or with a dispersion of a liquid medium of the kind mentioned above and a granular medium, in that the mosaic elements and the joint filling are then cooled to a temperature at which the liquid medium solidifies, wherein there is formed a composite $V_1$ which is held together by the solidified medium, in that the composite $V_1$ is subsequently stored at a temperature T below the solidification temperature of the liquid medium until the laying of the mosaic is begun, in that additional composites $V_2, V_3 \ldots V_n$ with the rest of the partial amounts $n_2, n_3 \ldots n_n$ of mosaic elements are produced and stored analogous to the method steps mentioned above, and finally, in order to lay the mosaic, the composites $V_1 \ldots V_n$ are transported to the laying site, arranged on the supporting surface so as to correspond to the predetermined mosaic and, from this time onward, exposed to the ambient temperature at the laying site for the purpose of thawing.

In other words: a partial amount $n_1$ is selected from the total of n mosaic elements to be laid and is placed on the work surface in the intended order of the mosaic elements relative to one another and is then enclosed by a frame which is likewise placed on the work surface. Alternatively, a frame can also be placed on the work surface first and only thereafter a selected partial amount $n_1$ of the total of n mosaic elements to be placed are deposited within the frame.

In this connection, the length and width of the work surface are at least as great as that of the frame. The spacing of the individual mosaic elements relative to one another corresponds to the width of the joints which are to remain between the mosaic elements in the subsequent finished mosaic.

In a next step, the joints between the individual mosaic elements set within the frame and also between the mosaic elements and the frame surrounding them are filled, according to choice, with a liquid medium or with a dispersion comprising liquid medium and a granular material, for example, sand or stone chippings.

The mosaic elements set within the frame are subsequently cooled together with the joint filling and the frame until the liquid medium is solidified. When solidified, the originally liquid medium which penetrates the joints and surrounds the individual mosaic elements in a net-like manner increasingly forms a fixed mesh or grating in which the mosaic elements are fixedly enclosed and held.

When the frame is removed, there remains a fixed composite $V_1$ formed of the mosaic elements and joint filling. This composite $V_1$ is now likewise removed from the work surface and transported to a storage location where it is stored at a temperature below the freezing or solidification temperature of the liquid medium.

It is provided in a constructional variant of the invention that before or after the placement of the frame, but in all cases before placing the partial amount $n_1$ of mosaic elements on the flat work surface, a plastically deformable material layer, for example, a sand layer, is first arranged on the work surface. The $n_1$ mosaic elements are then placed on this material layer in such a way that dimensional deviations in height from one mosaic element to the next, that is, dimensional deviations measured vertical to the work surface, are compensated by plastic deformation of this material layer. This can be carried out by pressing the mosaic elements into the material layer, whereupon the end faces of the mosaic elements remote of the work surface, for example, the surfaces of natural stones, lie at least approximately in a plane and thus form a surface which can be walked upon and/or driven upon.

It can be provided in a further preferred constructional variation that a foil which is impermeable to liquids is inserted between the plastically deformable material layer and the bottom surfaces of the mosaic elements which face the work surface. On the one hand, by means of this intermediate placement of foil, differences in height between the mosaic elements are compensated by different insertion depths accompanied by plastic deformation of the material layer and, on the other hand, the liquid medium is prevented from penetrating into the plastically deformable material layer when the liquid or dispersion is subsequently poured into the joints. After cooling and after removal of the frame, there results a composite of mosaic elements and joint material which has an extensively flat surface on the side remote of the work surface, whereas the surface on the side facing the work surface is uneven because of the discrepant heights of the mosaic elements. This composite can also be transported to an interim storage location as was described above.

Additional composites are now produced with the remaining partial amounts $n_2$, $n_3$ . . . $n_n$ of mosaic elements and stored until laying commences. The composites are then transported to the laying site. If it is necessary to transport over long distances, a cooled container in which the composites are kept at a temperature below the freezing point of the liquid medium can advantageously be provided as a transport container.

The composites are set relative to one another at the laying site individually one after the other on a profile-corrected pavement bed or subgrade, for example, a sand layer, until the entire mosaic is laid. The composites are exposed to the ambient temperature already during laying. If the ambient temperature is above the melting temperature of the liquid medium, the medium liquefies and seeps out or evaporates subsequently. Depending on requirements, the mosaic can be further treated after this by filling with sand or stone chippings and/or a compacting of the joints and mosaic elements can be carried out by vibrating.

In a particularly preferred constructional variant of the invention, water is used as liquid medium. Since water has its greatest density at +4° C., it expands when cooled to temperatures below its freezing point, which leads to a sufficiently firm enclosure of the mosaic elements between the joint filling and accordingly leads to a stable composite. Shaped blocks for imbricated, row, slab, ornamental or other forms of paving can be used as mosaic elements.

Depending on requirements, it is possible to transport and lay the individual composites in a conventional manner by hand or by means of known vacuum lifting technique. A paved surface finished in this way does not differ in character from the conventionally produced paved surfaces. However, the method according to the invention achieves the significant advantage that the laying process on-site is less time-consuming because the individual mosaic elements are already prepared with respect to their position relative to one another and to this extent need no longer be individually sorted and positioned.

This results in a further advantage which consists in that the laying of pavement can be carried out regardless of the weather to a great extent. While frost conditions impeded laying by the original methods, the method according to the invention is even assisted by frost because maintaining the stability of the composites during laying is facilitated as the ambient temperature decreases. Frost conditions merely delay the thawing of the water between the individual mosaic elements, but this has no disadvantageous consequences. A further advantage resulting from the use of the method according to the invention is improved working conditions for the persons laying the mosaic because the laying can be carried out from a standing posture with the use of appropriate auxiliary means.

It is noted that the frame can be constructed in different ways. For example, the frame can be formed of four side walls which are joined in a rectangle and have the approximate height of the mosaic elements. However, a flexible strip or tape running around the mosaic elements which are already placed on the work surface can also be provided, wherein this flexible tape is removed after the liquid medium solidifies or remains around the partial amount for the entire storage period or also during transport to the laying site. It is also conceivable that the joints that have not yet been filled at the outer circumference of the mosaic elements which are already deposited on the work surface are initially filled with means for sealing against liquid, such as plaster, and the rest of the joints are then filled with water or a dispersion.

The invention will be described more fully hereinafter with reference to an embodiment example. For example, if a road pavement is to be laid in accordance with the method according to the invention, individual composites of paving stones are prepared at a location separate from the laying site in preparation for this laying in that a predetermined number of paving stones, for example, 50 pieces, are arranged on a work surface and positioned relative to one another in the same positions to be occupied in the subsequent road pavement.

After this, the 50 stones are enclosed by a frame which is likewise placed on the work surface. The frame is produced from a plastic or metal which is dimensionally stable at least within a temperature range of −15° C. to +30° C. The joints between the paving stones and between the paving stones and the frame enclosing them are now filled with water and the entire arrangement is cooled to a temperature of −10° C. The water solidifies and the occurring ice forms a mesh or grating in which the paving stones are enclosed.

The frame is now removed and the composite of 50 paving stones and the ice filling the joints is lifted from the work surface by vacuum lifting technique and is transported to a storage location where it is temporarily stored also, for example, at a temperature of −10° C.

In order to facilitate the detachment of the frame from the composite and the detachment of the composite from the work surface, there can be disposed therebetween foils which prevent water from seeping through to the work surface or to the inside of the frame and which accordingly prevent an adhesive bonding by the ice.

In the manner described above, as many composites of this type as desired can be produced and intermediately stored. When the time comes to lay the road pavement, these composites are removed from intermediate storage and transported to the laying site. In order to prevent premature thawing of the water during transport, the transport can be carried out in cooled containers. At the laying site, the composites are removed from the cooled container individually one after the other and deposited on a prepared subgrade, for example, sand, and oriented in accordance with the desired arrangement of the pavement.

The laying of the road pavement is therefore largely independent from weather, since it can be undertaken at temperatures above or below 0° C. If the ambient temperature lies above 0° C., the ice melts immediately after laying, the water seeps out and/or evaporates. Depending on requirements, a supplementary filling of the joints can now take place, for example, with sand, and/or a compacting of the stones can be carried out through vibration.

While the foregoing description and drawings represent the preferred embodiments of the present invention, it will be obvious to those skilled in the art that various changes and modifications may be made therein without departing from the true spirit and scope of the present invention.

What is claimed is:

1. A method for laying a mosaic in which a quantity of individual mosaic elements are arranged on a common support surface so as to be separated from one another by joints, preferably for laying natural stones to form natural stone paving, comprising the steps of:

placing a partial amount of mosaic elements inside of a frame on a work surface at a location separate from a laying site for the mosaic, or framing such partial amount after placement on the work surface, wherein these mosaic elements are already positioned relative to one another in a manner corresponding to their respective position in the mosaic;

subsequently filling the joints between the mosaic elements with a liquid medium whose melting temperature and solidification temperature is approximately 0° C., or with said liquid medium and a granular medium;

then cooling the mosaic elements and the joint filling to a temperature at which the liquid medium solidifies, wherein there is formed a composite which is held together by the solidified medium;

subsequently storing the composite at a temperature below the solidification temperature of the liquid medium until the laying of the mosaic is begun;

producing and storing additional composites with the rest of the partial amounts of mosaic elements and analogous to the steps mentioned above; and in order to lay the mosaic, transporting the composites to the laying site, arranging the composites on the supporting surface so as to correspond to a predetermined mosaic, and exposing the composites to an ambient temperature at the laying site for thawing.

2. The method of claim 1, wherein the liquid medium is water.

3. The method according to claim 1, wherein a plastically deformable material layer is arranged on the work surface before placing the mosaic elements, wherein the mosaic elements are placed on the material layer in such a way that dimensional deviations from one mosaic element to the next, as measured vertical to the work surface, are compensated by plastic deformation of the material layer, so that end faces of the mosaic elements remote of the work surface lie at least approximately in a plane.

4. The method of claim 3, wherein the plastically deformable material layer is sand.

5. The method according to claim 3, wherein a foil which is impermeable to liquids is introduced between the plastically deformable material layer and end faces of the mosaic elements which face the work surface.

6. The method according to claim 1, wherein the frame is removed after solidification of the liquid medium.

7. The method according to claim 1, wherein a dispersion of water and at least one of sand and stone chippings is used as the joint filling.

8. The method according to claim 1, wherein the joint filling and the mosaic elements are cooled to a temperature of −10° C. and the composites are stored at a temperature of −10° C.

9. The method according to claim 1, wherein the composites are stored in a cooled container at a temperature of −10° C. while being transported to the laying site, removed from the cooled container individually one after the other at the laying site and placed on the work surface corresponding to the desired position of the mosaic elements in the mosaic.

10. The method according to claim 1, wherein shaped blocks for imbricated, row, slab, ornamental or other forms of paving are used as mosaic elements.

11. The method according to claim 1, wherein the support surface at the laying site is formed of a plastically deformable material.

12. The method according to claim 11, wherein the plastically deformable material is sand.

13. The method according to claim 1, wherein the frame is produced from a plastic or metal which is dimensionally stable at least within a temperature range of −15° C. to +30° C.

* * * * *